United States Patent [19]

Asama

[11] Patent Number: 5,076,719

[45] Date of Patent: Dec. 31, 1991

[54] PRINTING APPARATUS HAVING AUTOMATIC LOADING FUNCTION TO AVOID PRINT MEDIUM CORNER SNAGGING

[75] Inventor: Michio Asama, Kawasaki, Japan

[73] Assignee: Fujitsu Limited, Kawasaki, Japan

[21] Appl. No.: 531,145

[22] Filed: May 31, 1990

[30] Foreign Application Priority Data

May 31, 1989 [JP] Japan ..... 1-137862

[51] Int. Cl.[5] ..... B41J 25/28

[52] U.S. Cl. ..... 400/320; 400/322; 400/705; 400/708

[58] Field of Search ..... 400/319, 320, 320.1, 400/322, 323, 317.1, 315-316, 705, 705.1, 705.3, 708, 709.2, 713, 279, 283, 284, 285.5, 290, 64, 642

[56] References Cited

U.S. PATENT DOCUMENTS

| | | | |
|---|---|---|---|
| 4,272,204 | 6/1981 | Quinn et al. | 400/320 |
| 4,540,299 | 9/1985 | Yamada | 400/279 |
| 4,775,254 | 10/1988 | Nakao et al. | 400/279 |
| 4,778,296 | 10/1988 | Takahashi | 400/708 |
| 4,781,478 | 11/1988 | Eguchi | 400/322 |
| 4,938,618 | 7/1990 | Inoue et al. | 400/642 |
| 4,961,658 | 10/1990 | Takagi | 400/320 |

FOREIGN PATENT DOCUMENTS

| | | | |
|---|---|---|---|
| 0015553 | 9/1980 | European Pat. Off. | 400/705.1 |
| 0180059 | 5/1986 | European Pat. Off. | 400/708 |
| 0004789 | 1/1982 | Japan | 400/705.1 |
| 0075883 | 5/1982 | Japan | 400/708 |
| 58-201683 | 11/1983 | Japan . | |
| 0190882 | 10/1984 | Japan | 400/708 |
| 0217192 | 10/1985 | Japan | 400/708 |
| 61-37459 | 2/1986 | Japan . | |
| 61-58776 | 3/1986 | Japan . | |
| 0127369 | 6/1986 | Japan | 400/705 |
| 0248763 | 11/1986 | Japan | 400/708 |
| 61-270179 | 11/1986 | Japan . | |
| 0027169 | 2/1987 | Japan | 400/705.1 |
| 0149466 | 7/1987 | Japan | 400/708 |
| 0256679 | 11/1987 | Japan | 400/708 |
| 63-15773 | 1/1988 | Japan . | |
| 63-112177 | 5/1988 | Japan . | |
| 63-112178 | 5/1988 | Japan . | |
| 1-206077 | 8/1989 | Japan . | |

OTHER PUBLICATIONS

"Side-of-Forms, End of Forms, & Forms Jam-Detection Scheme", IBM Tech. Discl. Bulletin, vol. 20, No. 11A, 4/78, pp. 4266-4269.

*Primary Examiner*—Eugene H. Eickholt
*Attorney, Agent, or Firm*—Staas & Halsey

[57] ABSTRACT

A printing apparatus includes a platen on which a printing medium is set, a carriage which is movable along the platen and having a guide for guiding the printing medium to the platen and a printing head for making a print on the printing medium which is set on the platen, a first motor for moving the carriage along the platen, a second motor for feeding the printing medium, and a controller for controlling the first motor so that the carriage is moved to a first position until a tip end of the printing medium passes between the printing head and the platen and the carriage is moved to a second position after the tip end of the printing medium passes between the printing head and the platen, where the first and second positions are mutually different positions.

15 Claims, 8 Drawing Sheets

PRINTING APPARATUS HAVING AUTOMATIC LOADING FUNCTION TO AVOID PRINT MEDIUM CORNER SNAGGING

BACKGROUND OF THE INVENTION a. Field of the Invention

The present invention generally relates to printing apparatuses, and more particularly to a printing apparatus such as a printer and a typewriter having a carriage which moves along a platen on which a printing medium is placed.

b. Description of the Related Art

Recently, printing apparatuses have been is often provided with an automatic loading function in which a printing mediums such as a sheet of paper, is automatically loaded to a print position. When loading the printing paper, certain well known steps must be taken so that the printing paper does not hit a printing head, a paper holder and the like.

Generally, a printing head is mounted on a carriage which is driven by a space motor, and a paper guide is provided on the carriage. When setting the printing paper on a platen, the printing paper is transported along the paper guide so as to pass a predetermined path. However, because various kinds of printing paper are used ranging from a narrow printing paper to a wide printing paper, the position of the carriage is set so as to be convenient for all kinds of printing paper on the average.

Conventionally, the mechanism and control for making the automatic loading of the printing paper on the platen are relatively simple. However, when a narrow printing paper is loaded, a side edge of the printing paper passes a vicinity of the printing head and a paper jam may occur when a tip corner of the printing paper is caught by a mask hole which is formed between the printing head and the platen. On the other hand, when a wide printing paper is loaded, a wide portion of the printing paper is not held down by the paper guide. For this reason, a paper jam may occur when the tip end of the printing paper which passes the printing head floats from the platen and is caught by the paper holder such as a bail roller.

SUMMARY OF THE INVENTION

Accordingly, it is a general object of the present invention to provide a novel and useful printing apparatus in which the problems described above are eliminated.

Another and more specific object of the present invention is to provide a printing apparatus comprising a platen on which a printing medium is set, a carriage which is movable along the platen and having guide means for guiding the printing medium to the platen and a printing head for making a print on the printing medium which is set on the platen, first driving unit for moving the carriage along the platen, second driving unit for driving the platen so as to feed the printing medium, and control unit for controlling the first driving unit so that the carriage is moved to a first position until a tip end of the printing medium passes between the printing head and the platen, and the carriage is moved to a second position after the tip end of the printing medium passes between the printing head and the platen, where the first and second positions are mutually different positions. According to the printing apparatus of the present invention, it is possible to positively guide the printing medium regardless of the size of the printing medium, and without the possibility of a jam.

Other objects and further features of the present invention will be apparent from the following detailed description when read in conjunction with the accompanying drawings.

DESCRIPTION OF THE PREFERRED EMBODIMENTS

Figure 1:
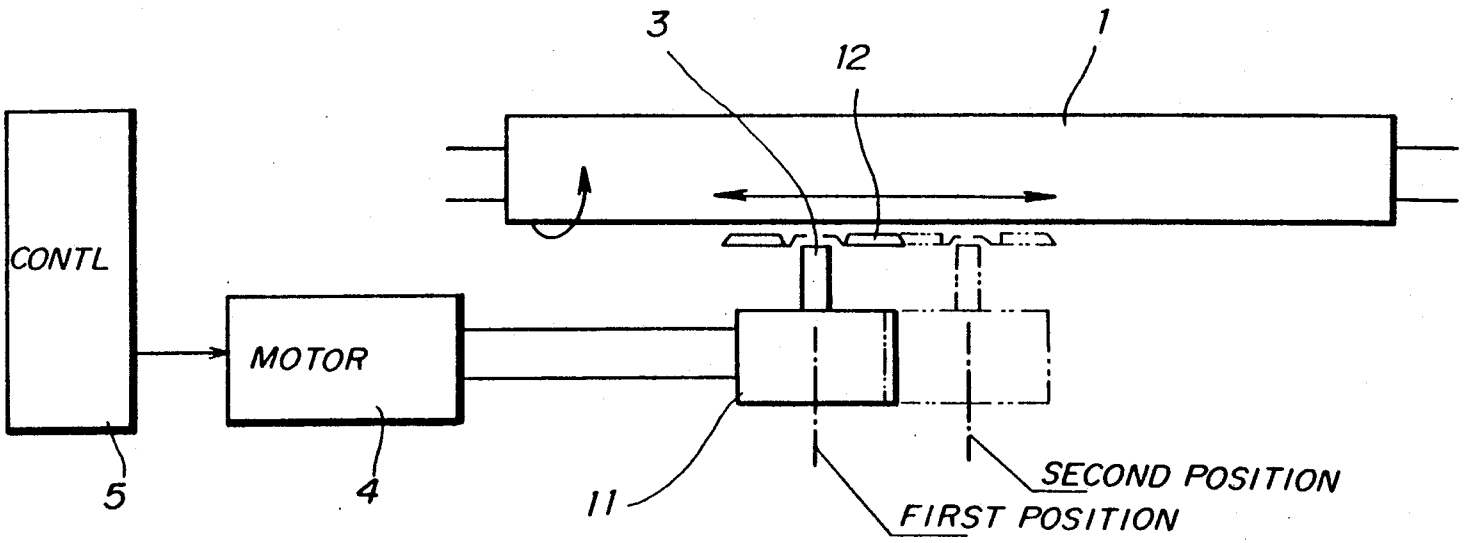
FIG. 1 is a diagram for explaining an operating principle of a printing apparatus according to the present invention.

First, a description will be given of an operating principle of a printing apparatus according to the present invention, by referring to FIG. 1. The printing apparatus shown in FIG. 1 generally has a platen 1, a carriage 11, a space motor 4 and a controller 5. The carriage 11 is driven by the space motor 4 and is movable along the platen 1. A paper guide 12 for guiding a printing medium on the platen 1 and a printing head 3 which makes prints on the printing medium are provided on the carriage 11. The controller 5 controls the operation of the space motor 4 so that when setting the printing medium on the platen 1, the carriage 11 is controlled to a first position until a tip end of the printing medium passes between the printing head 3 and the platen 1, and the carriage 11 is controlled to a second position which is different from the first position after the tip end of the printing medium passes between the printing head 3 and the platen 1.

Until the tip end of the printing medium passes between the printing head 3 and the platen 1, the carriage 11 is located at the first position and the paper guide 12 guides the transport of the printing medium in this position. In addition, after the tip end of the printing medium passes between the printing head 3 and the platen 1, the carriage 11 is moved to the second position and the paper guide 12 also moves to thereafter make the setting of the printing medium. As a result, it is possible to positively prevent a paper jam regardless of the width of the printing medium used.

Figure 2:
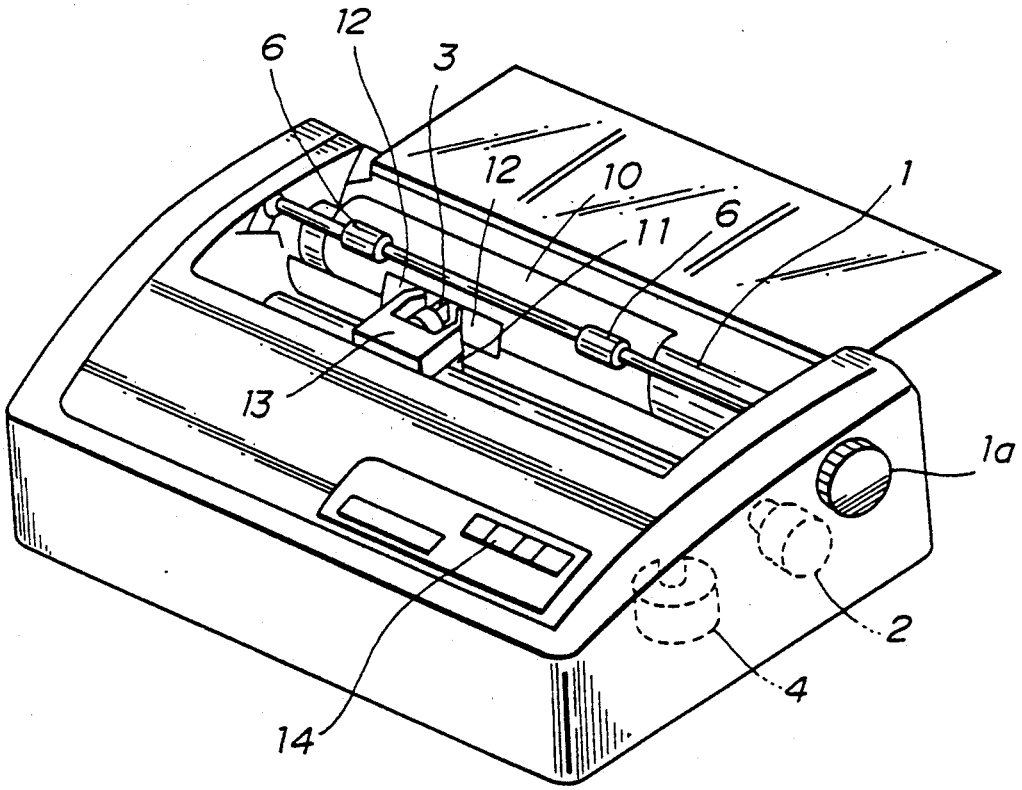
FIG. 2 is a perspective view generally showing an external appearance of a first embodiment of the printing apparatus according to the present invention.

Next, a description will be given of a first embodiment of the printing apparatus according to the present invention. FIG. 2 generally shows the first embodiment of the present invention. In this embodiment, the present invention is applied to a printer. In FIG. 2, the platen 1 on which a printing paper 10 is set is rotated by a line feed motor 2. A manual knob la is used for manually rotating the platen 1. A pair of bail rollers 6 are provided to hold down the printing paper 10 on the platen 1.

The paper guide 12 guides the printing paper 10 so that the printing paper 10 is wound on the platen 1. The paper guide 12 and the printing head 3 are mounted on the carriage 11 which is driven by the space motor 4 and is movable along the platen 1. The printing head 3, the paper guide 12, a ribbon cassette 13 and the like move together with the carriage 11. An operation panel 14 includes switches or buttons for controlling the functions of the printer.

Figure 3:
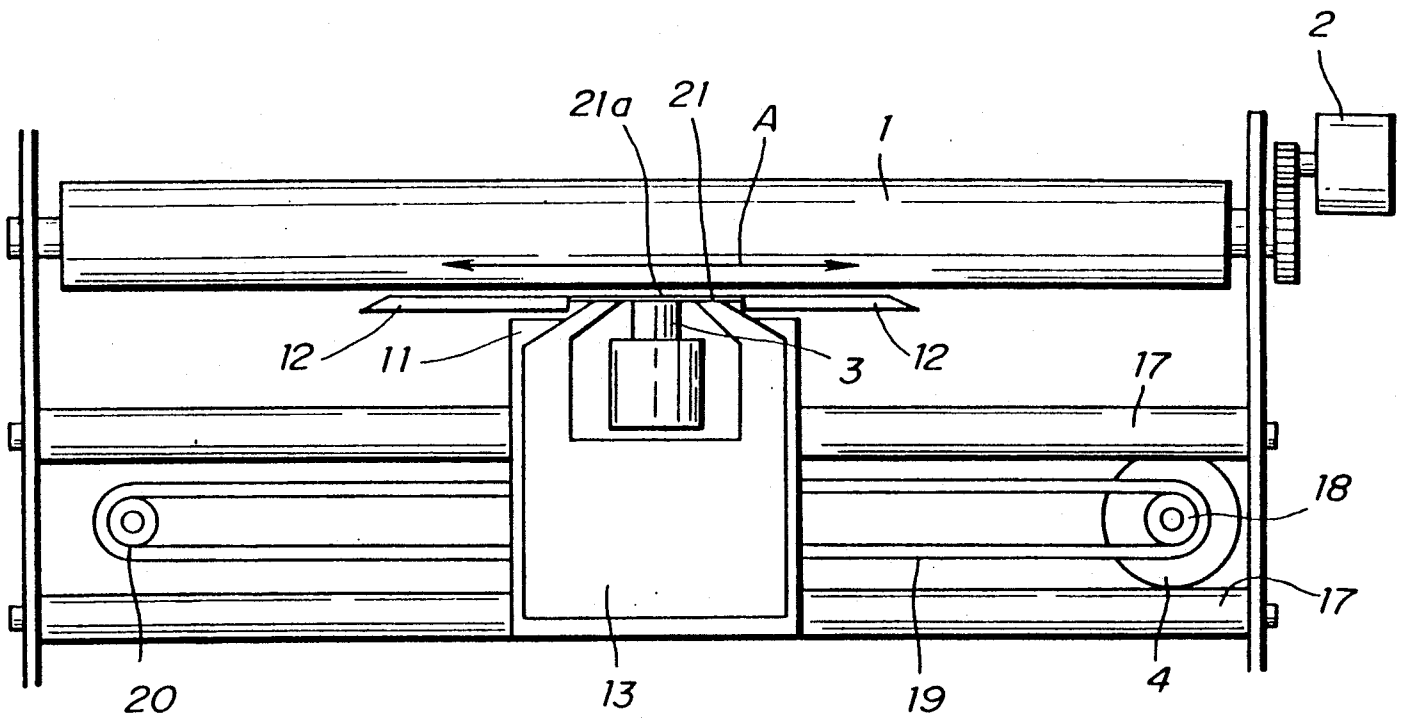
FIG. 3 is a plan view showing an essential part of the first embodiment.
Figure 4:
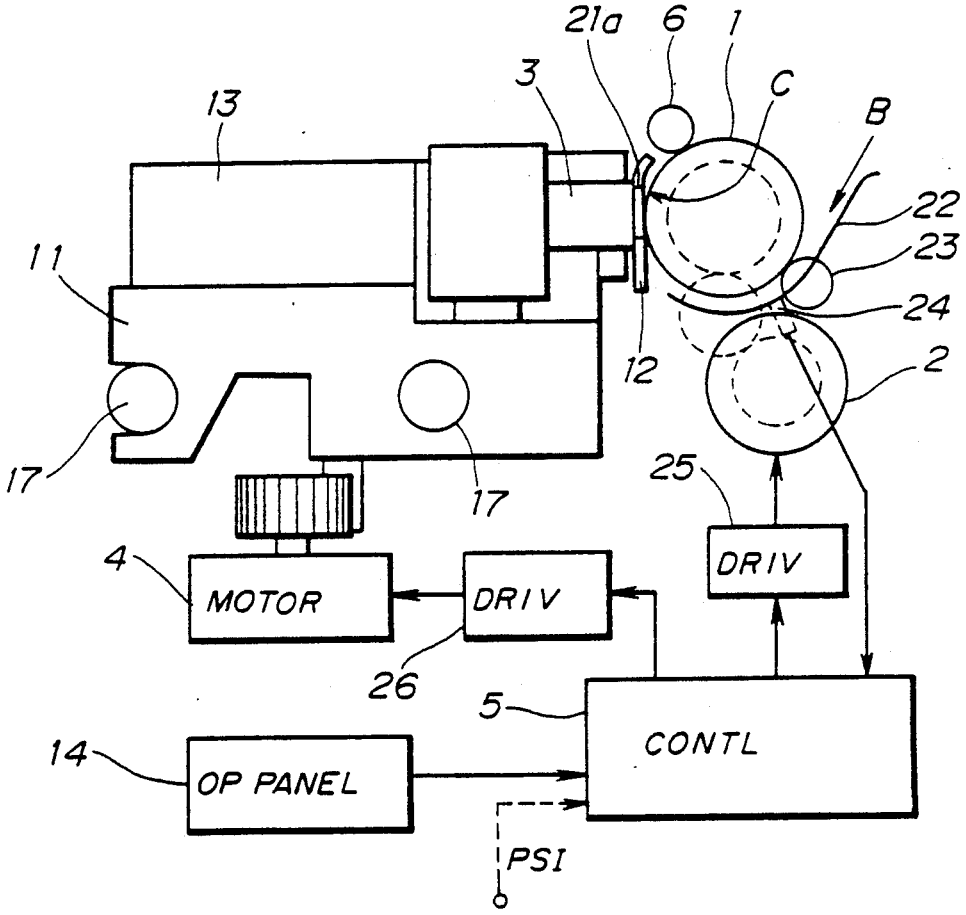
FIG. 4 is a side view showing an essential part of the first embodiment.
Figure 5:
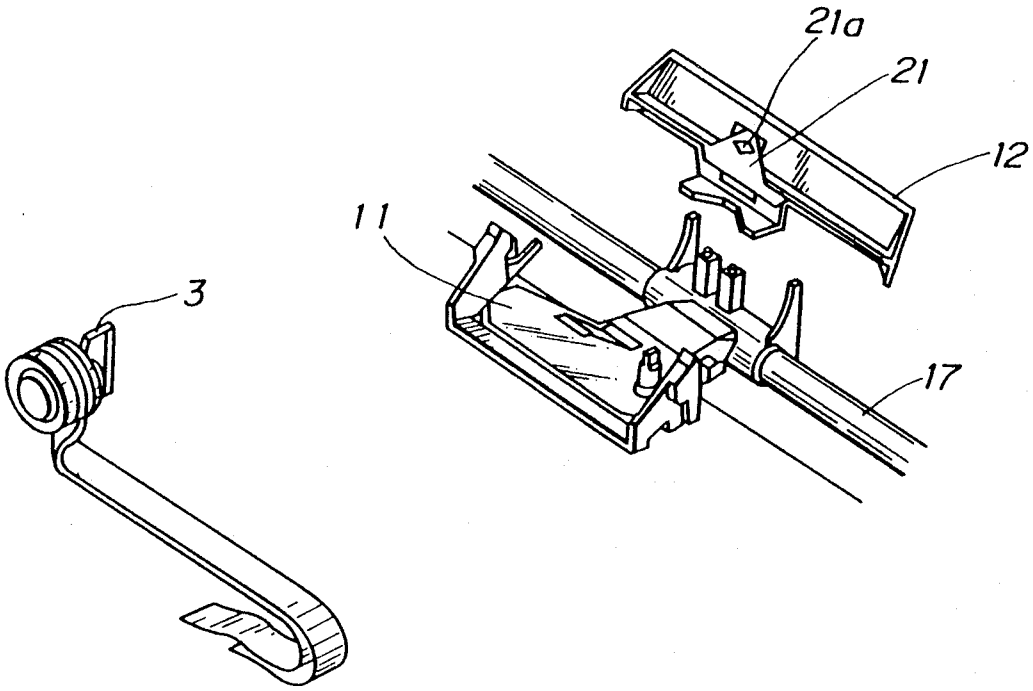
FIG. 5 is a disassembled perspective view showing an essential part of the first embodiment.

FIGS. 3 through 5 show essential parts of the first embodiment. In FIG. 3, the carriage 11 is slidably provided on a pair of guide rods 17 which are arranged parallel to the platen 1. The carriage 11 is moved in a direction A shown in FIG. 3 by a belt 19 which is provided between pulleys 18 and 20. The pulley 18 is driven by the space motor 4.

The paper guide 12 is provided on the carriage 11 along the platen 1, and a mask 21 is provided at a lower central portion of the paper guide 12. A mask hole 21*a* shown in FIGS. 3 through 5 is formed in a central portion of the mask 21 at a position matched to the position of the printing head 3.

A guide plate 22 is provided along the rear part of the platen 1 as shown in FIG. 4. The printing paper 10 is inserted from the rear part of the platen 1 as indicated by an arrow B in FIG. 4. Then, when the platen 1 is rotated, the printing paper 10 is pinched between a pinch roller 23 and the platen 1 and is wound on the platen 1 along the inner side of the guide plate 22. For example, a light reflection type paper sensor 24 is provided at a lower part of the platen 1, and this paper sensor 24 detects the printing paper 10 when the tip end of the printing paper 10 passes thereby.

In FIG. 4, the controller 5 includes a microprocessor (not shown) and the like. The operation panel 14 and an output line of the paper sensor 24 are coupled to an input end of an input/output interface (not shown) of the controller 5. On the other hand, a driving circuit 25 for the line feed motor 2 and a driving circuit 26 for the space motor 4 are respectively coupled to an output end of the input/output interface of the controller 5.

Figure 6:
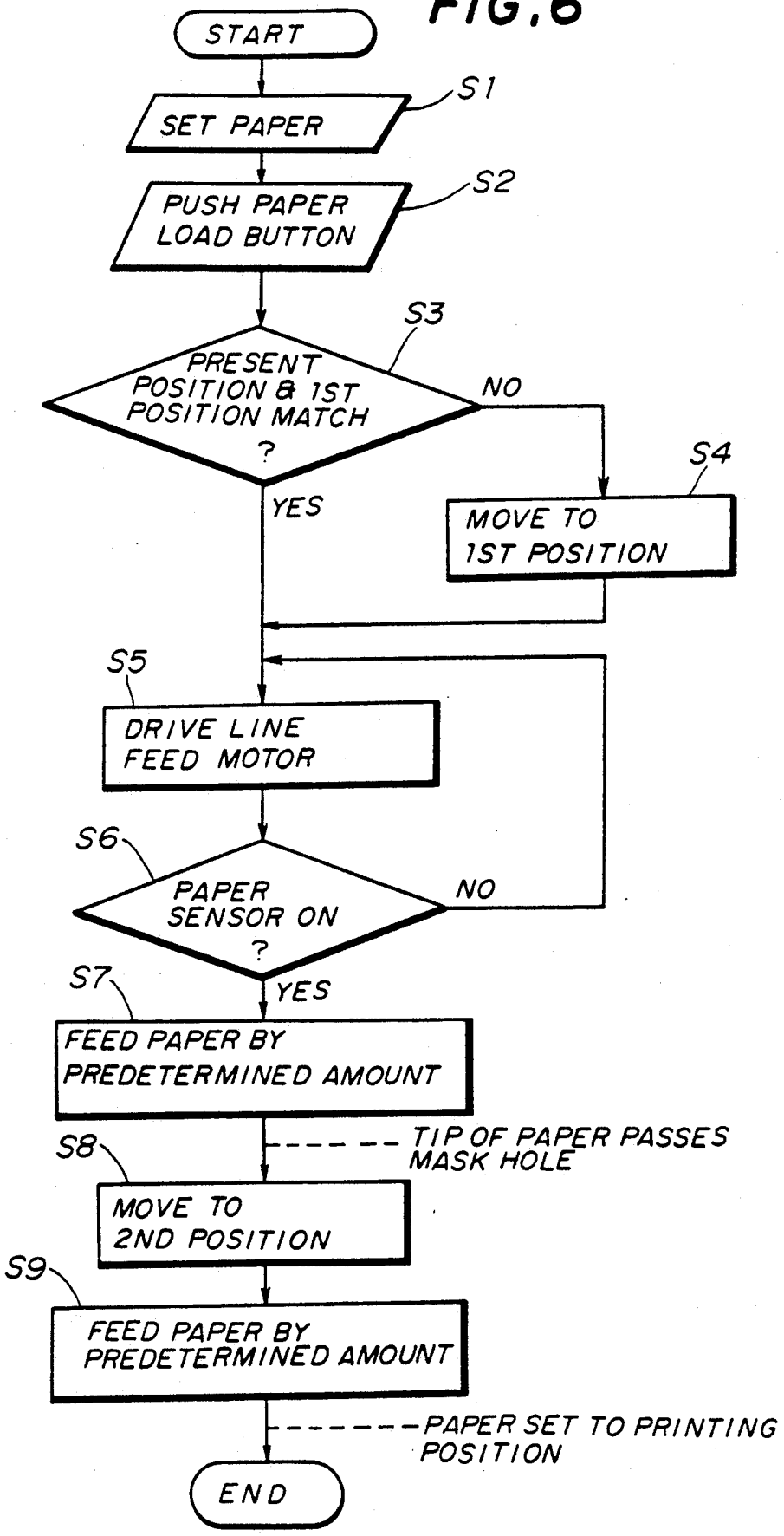
FIG. 6 is a flow chart for explaining an operation of the first embodiment.
Figure 7:
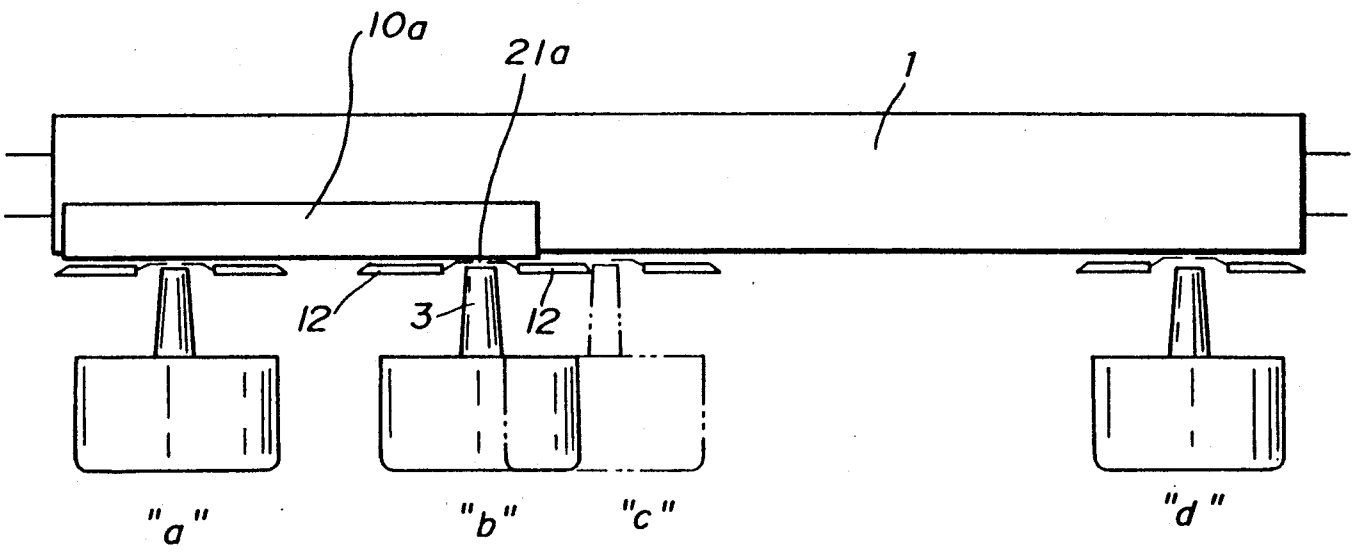
FIG. 7 is a front view showing an essential part of the first embodiment.

Next, a description will be given of the operation of the first embodiment, by referring to FIGS. 6 and 7. FIG. 6 shows a flow chart for explaining the operation of the first embodiment, and FIG. 7 shows limits of a moving range of the carriage 11. The carriage 11 is movable between positions "a" and "d".

In a step S1 shown in FIG. 6, an operator inserts the printing paper 10 from the rear part of the platen 1 as indicated by the arrow B in FIG. 4. Then, in a step S2, the operator pushes a paper load button of the operation panel 14 so as to start a paper loading process of the controller 5.

A step S3 discriminates whether or not a present position of the carriage 11 matches a first position "b" shown in FIG. 7. When the discrimination result in the step S3 is NO, a step S4 moves the carriage 11 to the first position "b" by driving the space motor 4. Because the printing head 3 is provided on the carriage 11, the printing head 3 is also moved to the first position "b" together with the carriage 11. As shown in FIG. 7, the first position "b" is selected so that when a printing paper 10*a* (for example, a post card) having a minimum width which is used on the printer is set to the leftmost position the printing head 3 is located on the left of the right edge of the printing paper 10*a*. At this first position "b", the paper guide 12 positively holds the printing sheet 10*a* down on the platen 1 and the tip right corner of the printing sheet 10*a* will not be caught by the mask hole 21*a*.

A step S5 rotates the platen 1 by driving the line feed motor 2 so that the printing paper 10 is wound on the platen 1 when the discrimination result in the step S3 is YES or after the step S4. A step S6 discriminates whether or not the paper sensor 24 detects the tip end of the printing paper 10. The process returns to the step S5 when the discrimination result in the step S6 is NO. A step S7 stops the line feed motor 2 after rotating the platen 1 a predetermined amount. For example, the printing paper 10 is stopped at a position C shown in FIG. 4 where the tip end of the printing paper 10 is past the mask hole 21*a* between the printing head 3 and the platen 1.

Then, a step S8 moves the carriage 11 to a second position "c" shown in FIG. 7 by driving the space motor 4. The printing head 3 is also moved to the second position "c" together with the carriage 11. The second position "c" is located to the right of the first position "b". This second position "c" is selected so that when the printing paper 10*a* is set, the right end portion of the printing paper 10*a* is held down on the platen 1 by the left part of the paper guide 12, and when a wide printing paper is set, the central portion of this wide printing paper is held down on the platen 1 by the paper guide 12.

Thereafter, in a state where the carriage 11 is fixed to the second position "c", a step S9 rotates the line feed motor 2 a predetermined amount so as to set the printing paper 10 to a printing position for printing a first line. As may be seen from FIG. 2, the printing paper 10 in this position is pinched between the bail rollers 6 and the platen 1.

Initially when the power of the printer is turned ON, the carriage 11 is moved from an arbitrary position to the position "a" (or "d") and then moved to the position "d" (or "a") and back to the original arbitrary position. By this initial process, the controller 5 reads the present position (arbitrary position) of the carriage 11. The controller 5 includes a read only memory (ROM, not shown) which stores the first and second positions "b" and "c", and thus, the controller 5 can carry out the necessary control to move the carriage 11 from the present position (arbitrary position) to the first position "b" and then to the second position "c" based on the read present position (arbitrary position).

Figure 8:
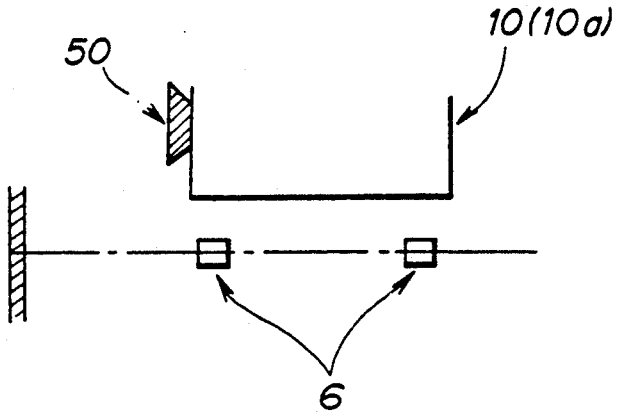
FIGS. 8 through 10 respectively are diagrams for explaining a relationship between the printing paper and bail rollers.
Figure 9:
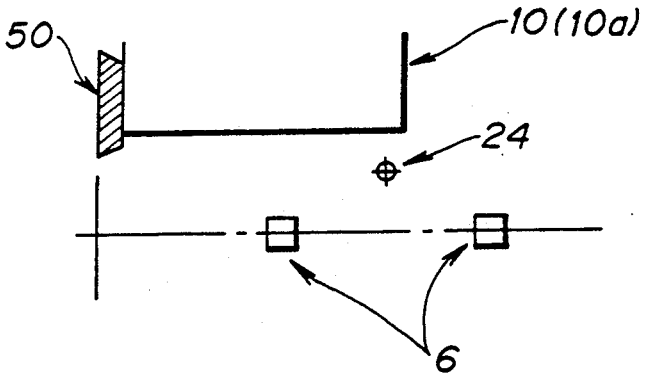
Figure 10:
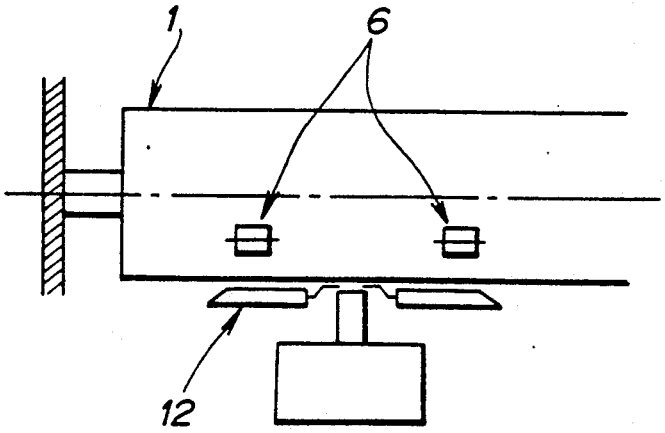

Next, a description will be given of the positional relationship of the paper guide 12 and the bail rollers 6 which is shown in FIGS. 8–10.

As shown in FIG. 8, it is desirable that both bail rollers 6 hold the printing paper 10 (or 10*a*) on the platen 1 when the left edge of the printing paper 10 is guided by an edge guide 50, especially in the case of a printing paper which is relatively stiff and is narrow.

When automatically loading the printing sheet 10 (or 10*a*) on the printer, it is necessary to detect the existence of the printing sheet 10 by the paper sensor 24 and enable the control operation of the controller 5 when the printing paper 10 is detected by the sensor 24. In other words, when the paper sensor 24 detects the printing paper 10, the paper loading process is carried out and it is necessary to positively guide the printing paper 10 in this case. As described above, it is essential to prevent the tip corner of the printing paper 10 from being caught by the mask hole 21*a*. When the paper guide 12 is positioned so that the mask hole 21*a* is aligned to the left of the paper sensor 24 at the first position "b", it is possible to positively prevent the tip corner of the printing paper 10 from being caught by the mask hole 21*a* because the mask hole 21*a* moves to the second position "c" after the tip corner of the printing paper 10 reaches the position of the paper guide 12. At the first position "b", at least one bail roller 6 holds the printing paper 10 down on the platen 1 (see FIG. 9).

As shown in FIG. 4, the printing paper 10 (or 10*a*) is guided by the paper guide 12 to a vicinity of the bail rollers 6. Hence, as shown in FIG. 10, it is desirable that the right and left parts of the paper guide 12 confronts the corresponding bail rollers 6 at the second position "c".

In the first embodiment described above, the first position "b" is fixed. However, it is possible to make the first position "b" variable depending on the width of the printing paper 10, as will be described hereunder.

In a second embodiment of the printing apparatus according to the present invention, the present invention is applied to the same printer referred to in the first embodiment. The printer of the second embodiment is provided with a means for recognizing the paper size, that is, the width of the printing paper 10.

For example, the paper size is input by the operator from a paper size input switch of the operation panel 14 shown in FIG. 14. As an alternative, paper size sensors (not shown) may be provided in the printer to automatically detect the paper size. The paper size information from the operation panel 14 or the paper size sensors is supplied to the controller 5. The paper size information PSI from the paper size sensors is indicated by a phantom line in FIG. 4. The ROM of the controller 5 stores the optimum first position "b" for various paper sizes, and reads out the corresponding first position "b" depending on the paper size information. Hence, the controller 5 can carry out the necessary control described above in conjunction with the first embodiment to control the carriage 11 to the optimum first position "b" depending on the paper size.

When the paper size information indicates that the printing paper 10 is wide and the carriage 11 need not be moved to the first position "b", the ROM of the controller 5 may store corresponding information indicating that the carriage 11 is to move to the second position "c" without the need to move to the first position "b".

Of course, the second position "c" need not be fixed as in the first embodiment, and it is possible to make the second position "c" variable depending on the paper size similarly as in the case of the second embodiment.

The present invention is not limited to the application to printers of the described embodiments, and is applicable to other printing apparatuses such as a typewriter. In addition, the platen need not necessarily be a rotatable drum, and may be a fixed flat platen. Further, the present invention is not limited to these embodiments, but various variations and modifications may be made without departing from the scope of the present invention.

What is claimed is:

1. A printing apparatus, comprising:

a platen on which a printing medium have left and right edges and a tip end is set, said tip end and said left and right edges of said printer medium forming two tip corners;

a cartridge which is movable along said platen, said carriage having printing medium guide means for guiding the printing medium to said platen, said guide means having a hole, and a printing head for making a print on the printing medium set on said platen through said hole in said guide means;

first driving means for moving said carriage along said platen;

second driving means for feeding the printing medium; and control means for controlling said first driving means to move said carriage to a first position while the second drive means feeds the printing medium until the tip end of the printing medium passes between said printing head and said platen and to move said carriage from the first position to a second position after the tip end of the printing medium passes between said printing head and said platen and beyond said hole in said guide means, the first and second positions being mutually different positions, wherein said hole of said guide means is between the two tip corners when said carriage is in said first position and outside the two tip corners when said carriage is in said second position of said printing medium.

2. The printing apparatus as claimed in claim 1, wherein said printing apparatus further comprises edge guide means for guiding a left edge of the printing medium, and wherein said printing head is located at a position to the left of a right edge of the printing medium when said carriage is located at the first position.

3. The printing apparatus as claimed in claim 2, wherein said printing head is located at a position to the right of the right edge of the printing medium when said carriage is located at the second position, and wherein said printing guide means guides at least a right portion of the printing medium when said carriage is located at the second position.

4. The printing apparatus as claimed in claim 3, wherein said printing guide means guides approximately a central portion of a specific printing medium when said carriage is located at the second position.

5. The printing apparatus as claimed in claim 1, wherein said printing apparatus further comprises detection means for detecting a position of the printing medium and for supplying the position detected to said control means.

6. The printing apparatus as claimed in claim 1, the first and second positions are fixed.

7. The printing apparatus as claimed in claim 1, wherein said printing apparatus further comprises a pair of bail rollers for holding the printing medium on said platen.

8. The printing apparatus as claimed in claim 7, wherein said bail rollers confront said printing medium guide means on both sides of said printing head.

9. The printing apparatus as claimed in claim 7, wherein at least one of said bail rollers confronts said printing medium guide means when said carriage is located at the first position.

10. The printing apparatus as claimed in claim 7, wherein said platen has a drum shape and said second driving means rotates said platen to feed the printing medium.

11. The printing apparatus as claimed in claim 1, wherein said printing apparatus further comprises size information input means for inputting to said control means size information related to the printing medium, the size information indicating at least a width of the printing medium, and wherein said control means variably determining at least the first position depending on the size information.

12. The printing apparatus as claimed in claim 11, wherein said control means variably determines the second position depending on the size information.

13. The printing apparatus as claimed in claim 11, wherein said size information input means comprises an operation panel, said operation panel includes switches for controlling functions of said printing apparatus.

14. The printing apparatus as claimed in claim 13, wherein said operation panel includes a switch for starting an automatic loading of the printing medium on said platen.

15. The printing apparatus as claimed in claim 1, wherein said printing apparatus further comprises a mask provided on said carriage, said mask having a mask hole at a position corresponding to a position of said printing head.

* * * * *

UNITED STATES PATENT AND TRADEMARK OFFICE

CERTIFICATE OF CORRECTION

PATENT NO. : 5,076,719

DATED : December 31, 1991

INVENTOR(S) : MICHIO ASAMA

It is certified that error appears in the above-identified patent and that said Letters Patent is hereby corrected as shown below:

Column 1, line 14, delete "is often";
line 16, "mediums" should be --medium--.
Column 5, line 29, "14" should be --2--.
Column 6, line 1, "cartridge" should be --carriage--;
line 51, after "claim 1," insert --wherein--.

Signed and Sealed this

Third Day of August, 1993

*Attest:*

Michael K. Kirk

MICHAEL K. KIRK

*Attesting Officer*

*Acting Commissioner of Patents and Trademarks*